US010604907B2

(12) United States Patent
Chilton

(10) Patent No.: US 10,604,907 B2
(45) Date of Patent: Mar. 31, 2020

(54) CORNER ROLLER CART FOR EXCAVATION SUPPORT STRUCTURES AND METHODS FOR USING SAME

(71) Applicant: National Trench Safety, LLC, Houston, TX (US)

(72) Inventor: Ronald W. Chilton, Montgomery, TX (US)

(73) Assignee: NATIONAL TRENCH SAFETY, LLC, Houston, TX (US)

( * ) Notice: Subject to any disclaimer, the term of this patent is extended or adjusted under 35 U.S.C. 154(b) by 0 days.

(21) Appl. No.: 16/193,556

(22) Filed: Nov. 16, 2018

(65) Prior Publication Data

US 2019/0153695 A1 May 23, 2019

Related U.S. Application Data

(60) Provisional application No. 62/589,880, filed on Nov. 22, 2017.

(51) Int. Cl.
*E02D 17/08* (2006.01)

(52) U.S. Cl.
CPC ..... *E02D 17/08* (2013.01)

(58) Field of Classification Search
CPC combination set(s) only.
See application file for complete search history.

(56) References Cited

U.S. PATENT DOCUMENTS 3,309,799 A 3/1967 Kinkade
3,710,578 A 1/1973 Inoue
3,916,629 A 11/1975 Thompson
3,950,952 A 4/1976 Krings
4,019,328 A 4/1977 Koehl
4,376,599 A 3/1983 Krings
4,453,863 A 6/1984 Sutton et al.
4,657,442 A 4/1987 Krings
4,685,837 A * 8/1987 Cicanese ..... E02D 17/08 405/272
4,874,271 A 10/1989 Arnold
5,096,334 A 3/1992 Plank
(Continued)

FOREIGN PATENT DOCUMENTS

EP 2261424 12/2010

OTHER PUBLICATIONS

International Search Report and Written Opinion for International Application No. PCT/US2018/061438, dated Feb. 4, 2019.
(Continued)

*Primary Examiner* — Kyle Armstrong
(74) *Attorney, Agent, or Firm* — Edmonds & Cmaidalka, P.C.

(57) ABSTRACT

An excavation support system and methods for installing and using same. The system includes a corner cart having a generally vertical back plate having a front surface, a back surface, a top end, and a bottom end; a generally horizontal base plate having a top side and a bottom side, the base plate attached to the back plate at about a 90-degree angle, proximate the bottom end of the back plate; at least one roller, connected to the back plate, extending from the back surface thereof, and a corner swivel brace disposed on the top side of the base plate and connected to the front surface of the back plate.

20 Claims, 11 Drawing Sheets

(56) References Cited

U.S. PATENT DOCUMENTS

| | | | | |
|---|---|---|---|---|
| 5,107,963 | A | 4/1992 | Rocca et al. | |
| 5,190,412 | A * | 3/1993 | Salvatore | E02D 17/08 405/272 |
| 5,302,054 | A | 4/1994 | Winkler et al. | |
| 5,310,289 | A | 5/1994 | Hess | |
| 5,310,290 | A * | 5/1994 | Spencer | E02D 17/086 405/273 |
| 5,503,504 | A | 4/1996 | Hess et al. | |
| 5,931,607 | A | 8/1999 | Hess | |
| 6,267,538 | B1 * | 7/2001 | Caldwell | E02D 17/08 405/272 |
| 6,416,259 | B1 * | 7/2002 | Meyer | E02D 17/04 405/272 |
| 6,821,057 | B1 | 11/2004 | Kadiu | |
| 6,848,865 | B2 | 2/2005 | Kadiu | |
| 6,984,092 | B1 * | 1/2006 | Meyer | E02D 17/04 405/272 |
| 7,056,068 | B2 | 6/2006 | Kadiu | |
| 7,258,511 | B1 | 8/2007 | Cerda | |
| 7,883,296 | B2 | 2/2011 | Meyer | |
| 8,403,599 | B2 | 3/2013 | Hawkins et al. | |
| 2002/0159844 | A1 | 10/2002 | Meyer | |
| 2003/0031514 | A1 * | 2/2003 | Nicholson | E02D 17/083 405/133 |
| 2004/0005197 | A1 | 1/2004 | Kadiu | |
| 2009/0110490 | A1 | 4/2009 | Hess | |
| 2011/0058903 | A1 | 3/2011 | Kadiu | |

OTHER PUBLICATIONS

International Search Report and Written Opinion for International Application No. PCT/US2018/061433, dated Feb. 1, 2019.

* cited by examiner

CORNER ROLLER CART FOR EXCAVATION SUPPORT STRUCTURES AND METHODS FOR USING SAME

BACKGROUND

Field

Embodiments of the present invention generally relate to the installation and removal of excavation support structures, in particular to the installation and removal of slide rail trench shoring systems.

Description of the Related Art

In the excavation industry, cave-in and trench collapse are common safety hazards associated with open trench excavation methods. In addition to the inherent safety concerns, there are also productivity issues that must be addressed due to the man-hour requirements for the installation and removal of the excavation support structure.

Although slide rail trench shoring systems often eliminate many of the safety and productivity issues found when using trench shields, tight sheeting, beam and plate systems and wood shoring systems, there is still a need for continuous safety and productivity improvements in the industry. More particularly, there is a need for improvements in safety and job efficiency with the vertical mobility of hydraulic brace legs during installation and removal of slide rail trench shoring systems.

SUMMARY

A corner roller cart for an excavation system and methods for installing and using same are provided. The corner cart can include a generally vertical back plate having a front surface, a back surface, a top end, and a bottom end; a generally horizontal base plate having a top side and a bottom side, the base plate attached to the back plate at about a 90-degree angle, proximate the bottom end of the back plate; at least one roller, connected to the back plate, extending from the back surface thereof; and a corner swivel brace disposed on the top side of the base plate and connected to the front surface of the back plate. The corner swivel brace can include an adapter configured to attach the corner swivel brace to the back plate of the corner cart; a generally vertical axle support bar having a top end and a bottom end, wherein the axle support bar is connected to the adapter; a generally vertical tube support having a top end and a bottom end; and a top plate having a first end and a second end, wherein the first end is disposed on the top end of the tube support, and the second end is generally perpendicular to and connected to the axle support bar. The axle support bar is able to swivel the support tube and the top plate relative to the vertical axis of the adapter. The cart can further include a first side plate and a second side plate, wherein the side plates are generally L-shaped, having a generally vertical top portion, and a bottom portion that is generally perpendicular to the top portion, wherein the top portion of both side plates is attached to and generally perpendicular to the back surface of the back plate, wherein the bottom portion of both side plates is attached to and generally perpendicular to the bottom side of the base plate, and wherein the first side plate and the second side plate are generally parallel to one another; and a first plurality of guide plates attached to, and generally perpendicular to, the generally vertical top portion of the first side plate, and a second plurality of guide plates that is attached to, and generally perpendicular to, the generally vertical top portion of the second side plate. The corner roller cart is movable in an upward and downward direction relative to a vertical axis.

A method of installing a corner roller cart in an excavation support system can include disposing at least a first corner roller cart on a corner slide-rail post; moving the corner roller cart in the downward direction relative to the vertical axis of the corner slide-rail post to a desired stopping position; and connecting a linking tube to the first corner roller cart in vertical alignment therewith, the linking tube having a top end and a bottom end, wherein the bottom end is positioned between the first side plate and the second side plate of the first slide cart, and wherein the top end is positioned between the first side plate and the second side plate of the second corner roller cart.

BRIEF DESCRIPTION OF THE DRAWINGS

The present disclosure is best understood from the following detailed description when read with the accompanying Figures. It is emphasized that, in accordance with the standard practice in industry, various features are not drawn to scale. In fact, the dimensions of the various features may be arbitrarily increased or reduced for clarity of discussion.

DETAILED DESCRIPTION

Figure 1:
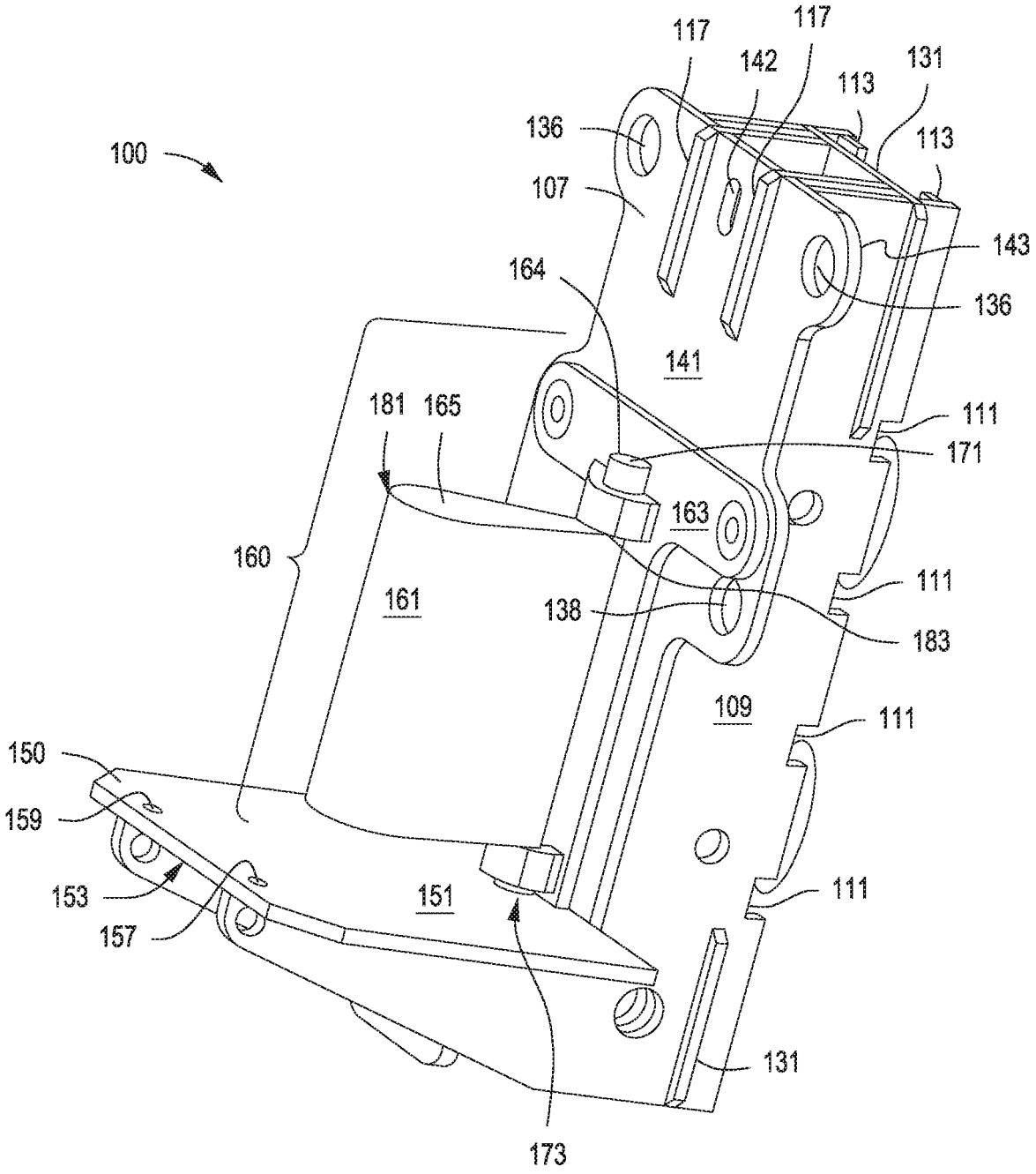
FIG. 1 depicts a side elevation view of an illustrative corner roller cart for an excavation support system, according to one or more embodiments provided herein.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

The terms "up" and "down"; "upward" and "downward"; "upper" and "lower"; "upwardly" and "downwardly"; "above" and "below"; and other like terms as used herein refer to relative positions to one another and are not intended to denote a particular spatial orientation since the apparatus and methods of using the same may be equally effective at various angles or orientations.

FIG. 1 depicts a side elevation view of an illustrative corner roller cart 100 for an excavation support system, according to one or more embodiments. The corner roller cart 100 can include at least one roller 112. The at least one roller 112 can allow for decreased friction between the corner roller cart 100 and a corner slide-rail post (see FIG. 6, 200); thereby, facilitating more ease of movement in an upward and downward direction relative to the vertical axis of the corner slide-rail post (see FIG. 6, 200). The at least one roller 112 of the corner roller cart 100 can be adapted to slide onto the corner slide-rail post (see FIG. 6, 200) and secure thereto. The at least one roller 112 can be positioned onto a shaft (not shown), wherein the shaft can be configured to fit within an aperture 198. It should be noted that the at least one roller 112 can rotate either around the shaft or with the shaft.

The corner roller cart 100 can include a back plate 107 with two or more side plates 109 attached thereto that can provide a point of attachment for a plurality of guide rails or guide plates 113. The back plate 107 can be generally flat and positioned, when in use, in a generally vertical orientation. The back plate 107 can have a front surface 141 and a back surface 143. The side plates 109 can be attached to the back surface 143 of the back plate 107, in parallel orientation to one another. The side plates 109 can be generally L-shaped. The side plates 109 can provide support for the base plate 150 and the back plate 107. Moreover, the side plates 109 can provide a point of attachment for the plurality of guide plates 113. At least one spacer plate 131 can be disposed through the side plates 109. It should be noted that the at least one roller 112 can extend from the back plate 107.

The spacer plate 131 can be generally rectangular, and can securely maintain the preferred spacing or distance between the side plates 109. The separation distance between the side plates 109 can be from about 5 inches to about 12 inches, from about 6 inches to about 11 inches, or from about 7 inches to about 10 inches. For example, the separation distance between the side plates 109 can be up to about 12 inches, up to about 11 inches, up to about 10 inches, or up to about 9 inches. It should be noted that two spacer plates 131 are shown in FIG. 1, but other embodiments can include two or more spacer plates 131.

The corner roller cart 100 can include two or more lock plates 117 to secure the spacer plate 131 to the side plates 109. As shown in FIG. 1, the lock plates 117 can be generally square or generally rectangular, and can be configured to fit within generally vertical notches disposed on the back plate 107. Two lock plates 117 are shown, in parallel orientation to one another. In other embodiments, the corner roller cart 100 can include two or more lock plates 117.

The plurality of guide plates 113 can be attached, in a generally perpendicular orientation, to each of the side plates 109. The plurality of guide plates 113 can be disposed along the longitudinal axis of each of the side plates 109, and can be configured to connect or clamp the corner roller cart 100 to a corner slide-rail post (see FIG. 6, 200). The total number of guide plates 113 can vary, depending upon the length of the side plates 109.

The plurality of guide plates 113 can be separated by notches 111. The notches 111 can essentially function as spacers between each one of the pluralities of guide plates 113 disposed along the longitudinal axis of the side plates 109. For example, the length of the notches 111 can vary, depending upon the preferred separation distance between each of the plurality of guide plates 113.

The base plate or shoe (hereinafter "base plate") 150 can be generally horizontal and used for supporting at least one brace leg, or up to two brace legs (see FIG. 8, 300). The base plate 150 can be attached to the back plate 107 at or about a 90-degree angle. The base plate 150 can include a top side 151 and a bottom side 153, and can have at least two apertures 157, 159 positioned opposite the location of attachment to the back plate 107, i.e., toward the front of the base plate 150. Essentially, the base plate 150 can function as a seat or table for the placement, joinder, and connection of at least one brace leg (see FIG. 8, 300), or up to two brace legs (see FIG. 8, 300) to the corner roller cart 100.

The corner swivel brace assembly 160 can be used to support the ends of two brace legs (see FIG. 8, 300) on the base plate 150, forming an approximate 90-degree angle therebetween. In some embodiments, the position of the corner brace assembly 160 can be maintained by hydraulic pressure applied thereto. Limit pins can be used to lock the corner brace assembly 160 into position along the vertical axis of the corner slide-rail post (see FIG. 6, 200), thereby limiting movement of the corner brace assembly 160 in the absence of hydraulic pressure being applied thereto. In other embodiments, the corner brace assembly 160 can be disposed on the base plate 150 and can be connected to the front surface 141 of the back plate 107.

The corner swivel brace assembly 160 can include an adapter 163, an axle support bar 164, a teardrop support 161, and a top plate 162. The adapter 163 can be generally T-shaped, and can be configured to attach the corner swivel brace assembly 160 to the back plate 107 of the corner roller cart 100. The adapter 163 can include apertures formed therethrough, on either side of the "T", which can be configured to align with apertures 138, 140 in the back plate 107. Connectors such as pins, dowels, screws, clamps, or any of a variety of fasteners, can be inserted through the aligned apertures to attach the adapter 163 to the back plate 107.

In some embodiments, the generally vertical axle support bar 164 can be connected to the adapter 163, disposed along the vertical axis thereof. In other embodiments, the axle support bar 164 and the adapter 163 can be machined or engineered as one piece. The axle support bar 164 can include a top end 171 and a bottom end 173. Moreover, the axle support bar 164 can facilitate swivel movement of the corner swivel brace assembly 160, thereby allowing an adjustable connection for two hydraulic brace legs (see FIG. 8, 300). The teardrop support 161 can function as a stop for each hydraulic brace leg (see FIG. 8, 300). Moreover, the teardrop support 161 can facilitate adjoining two brace legs (see FIG. 8, 300) to form an approximate 90-degree angle.

The top plate 165 of the teardrop support 161 can have a first end 181 and a second end 183, where the first end 181 can be disposed on top of the teardrop support 161, and the second end 183 can be generally perpendicular to and connected to the axle support bar 164. In some embodiments, the top plate 165 can also include a lift ring attached thereto (not shown). The lift ring can be connected to a hook attached to an excavator for the purpose of facilitating the lifting and lowering of the corner roller cart 100 along the vertical axis of the corner slide-rail (see FIG. 6, 200) during installation and removal thereof. In other embodiments, as shown, where the corner roller cart 100 can be fabricated without the lift ring, other methods can be utilized for installation and removal thereof. For example, a boom of an excavator can be used to essentially hammer the corner roller cart 100 in the downward position, whereas lift cables or chains can be connected to lift points or apertures 136, 138, and 140 positioned about the perimeter of the corner roller cart 100 for installation and removal thereof.

Figure 1A:
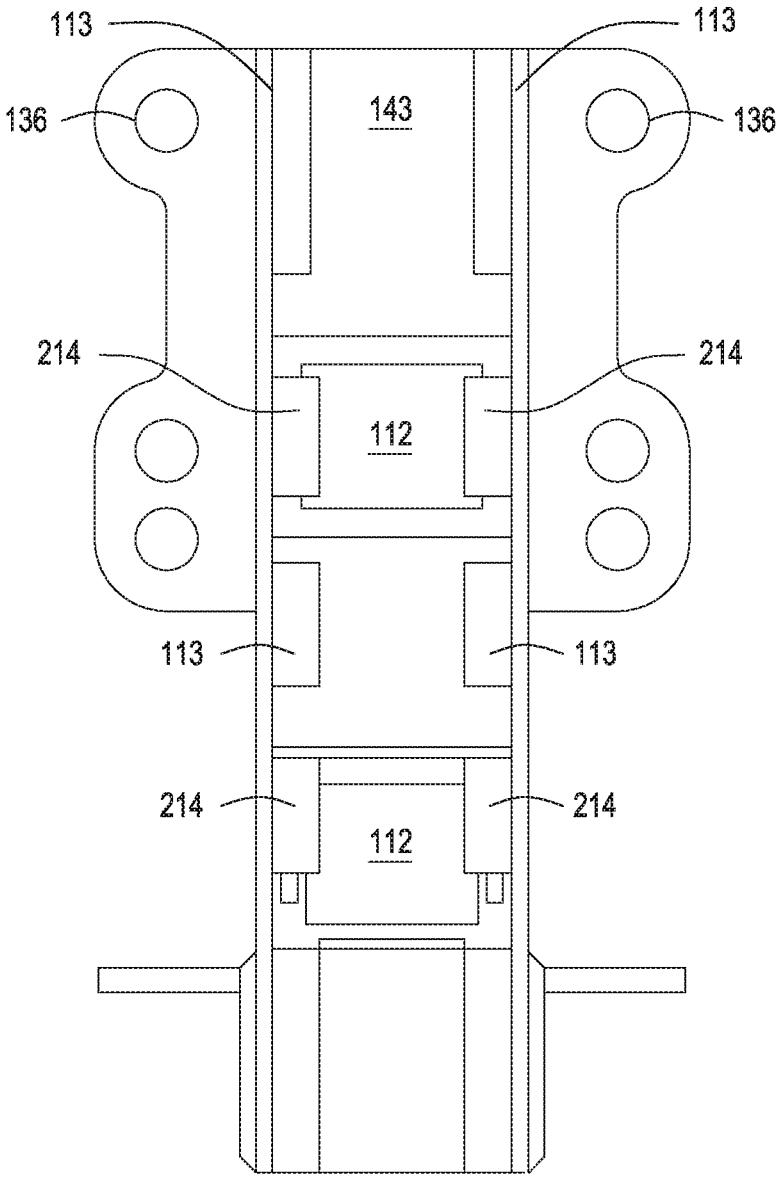
FIG. 1A depicts a plan view of an illustrative corner roller cart for an excavation support system, according to one or more embodiments provided herein.

FIG. 1A depicts a plan view of the back surface of an illustrative corner roller cart for an excavation support system, according to one or more embodiments provided herein. The back surface 143 of the corner roller cart 100 can include at least one roller 112, where the at least one roller 112 can be positioned between the side plates 109, and secured in place by a housing or rigid caster 214. FIG. 1A also depicts apertures 136, 138, and 140 that can be used as lift points for the purpose of moving the corner roller cart 100 in the upward and downward direction, or as connecting points for the purpose of connecting the corner roller cart 100 to the corner slide-rail post (see FIG. 6, 200), or for connecting one or more brace legs (see FIG. 8, 300) to the corner roller cart 100.

Figure 2:
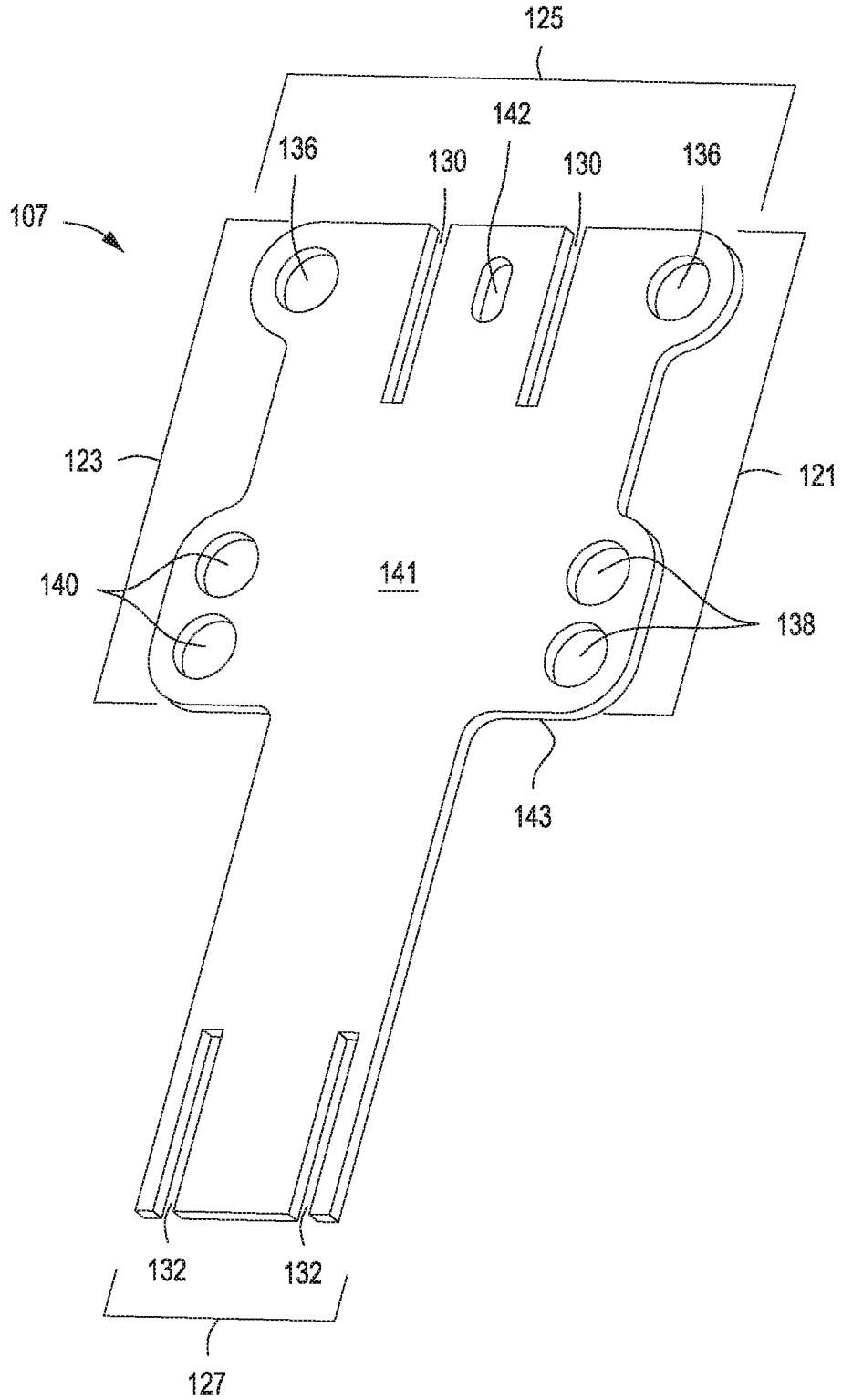
FIG. 2 depicts a perspective view of an illustrative back plate for the corner roller cart of FIG. 1, according to one or more embodiments provided herein.

FIG. 2 depicts a perspective view of the back plate 107 for the corner roller cart 100 of FIG. 1, according to one or more embodiments. In addition to the discussion above, the back plate 107 can also include a top end 125, a bottom end 127, a first outer edge 121, and a second outer edge 123. More specifically, the at least one aperture 136 formed therethrough can be positioned proximate the top end 125 of both the first outer edge 121 and the second outer edge 123. Further, the one or more additional apertures 142 formed therethrough can be positioned proximate the top end 125. The one or more additional apertures 138, 140 formed therethrough can be positioned below the at least one aperture 136 positioned proximate the top end 125 of both the first outer edge 121 and the second outer edge 123. Moreover, the back plate 107 can include two or more generally vertical top notches 130 that can be configured to engage with the lock plates 117. The back plate 107 can also include two or more generally vertical bottom notches 132 that can be configured to engage with corresponding lock plates.

As shown, for example, in FIGS. 1, 1A, and 2, at least a portion of both the first outer edge 121 and the second outer edge 123, proximate the top end 125 of the back plate 107 can be curved. The back plate 107 can have at least one aperture formed therethrough (seven are shown 136, 138, and 140 in FIG. 2). The apertures 136, 138, and 140 can be used to engage with one or more connecting or securing devices, such as pins, dowels, screws, clamps, or any of a variety of fasteners. In some embodiments, the apertures 138 and 140 can provide a point of connection between the back plate 107 and the corner swivel brace assembly 160. The apertures 136 located proximate the top end 125 can be formed through the convex, curved portion of the first outer edge 121 and the second outer edge 123.

Figure 3:
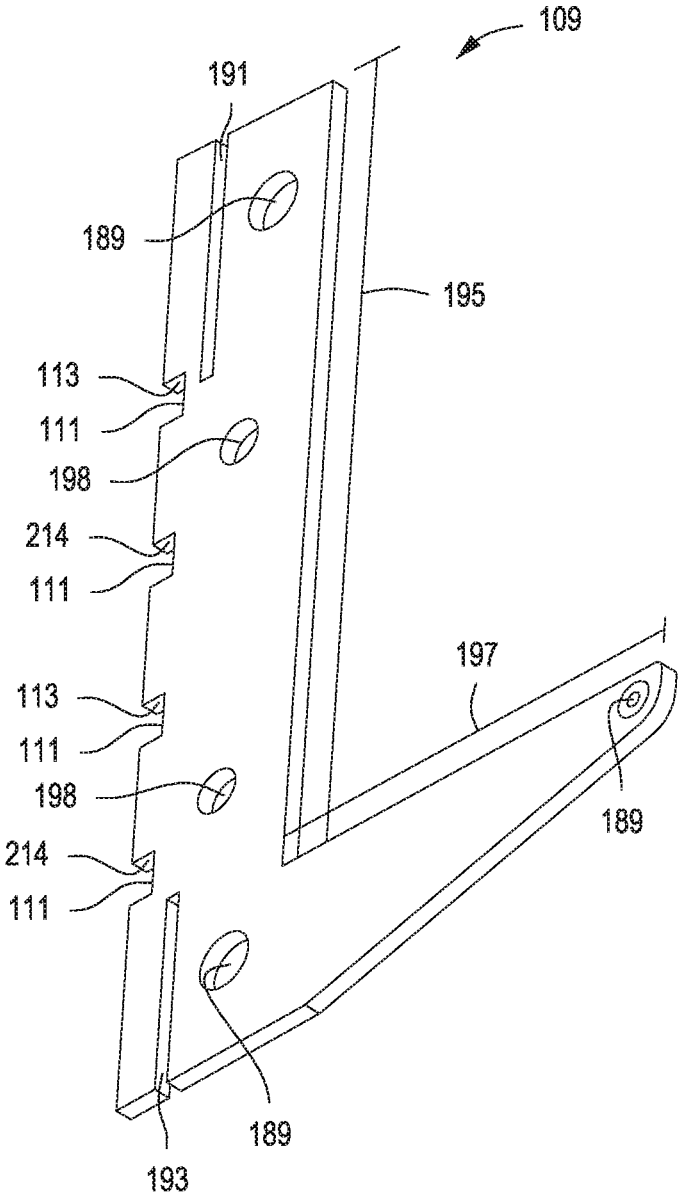
FIG. 3 depicts a perspective view of an illustrative side plate for the corner roller cart of FIG. 1, according to one or more embodiments provided herein.

FIG. 3 depicts a perspective view of an illustrative side plate 109 for the corner roller cart 100 of FIG. 1, according to one or more embodiments provided herein. Referring to FIGS. 1 and 3, the corner roller cart 100 can have at least two side plates 109, or a first side plate 109 and a second side plate 109. In some embodiments, the side plates 109 can be L-shaped, having a generally vertical top portion 195 and a bottom portion 197 that is generally perpendicular to the top portion 195. In other embodiments, the at least two side plates 109 can be generally vertical and I-shaped. The side plates 109 can include at least 2 apertures 189. The side plates 109 can have at least one generally vertical top notch 191, and at least one generally vertical bottom notch 193 that can be configured to engage with at least one spacer plate 131. The side plates 109 can also include apertures 198 that can be configured to position a spindle or shaft for the at least one roller 112 therein.

At least one guide plate 113 can be attached to, and generally perpendicular to, the generally vertical top portion 195 of the first side plate 109. Likewise, at least one guide plate 113 can be attached to, and generally perpendicular to, the generally vertical top portion 195 of the second side plate 109. Moreover, the side plates 109 can also include two or more notches 111 distributed along an outer vertical edge. The notches 111 can essentially function as spacers between each one of the pluralities of guide plates 113. Similarly, the notches 111 can essentially function as spacers between each of the at least one rollers 112. The length of the notches 111 can vary, depending upon the preferred separation distance between each of the pluralities of guide plates 113, or between each of the at least one rollers 112.

The first side plate 109 and the second side plate 109 can be in parallel relation to one another. At least one spacer plate 131 can be disposed through the generally vertical corresponding top notches 191 of the side plates 109. The spacer plate 131 can securely maintain the preferred spacing or distance between the side plates 109. The separation distance between the side plates 109 can be from about 5 inches to about 12 inches, from about 6 inches to about 11 inches, from about 7 inches to about 10 inches, or from about 8 inches to about 9 inches. The separation distance can be up to 12 inches, up to 11 inches, up to 10 inches, or up to 9 inches.

Figure 4:
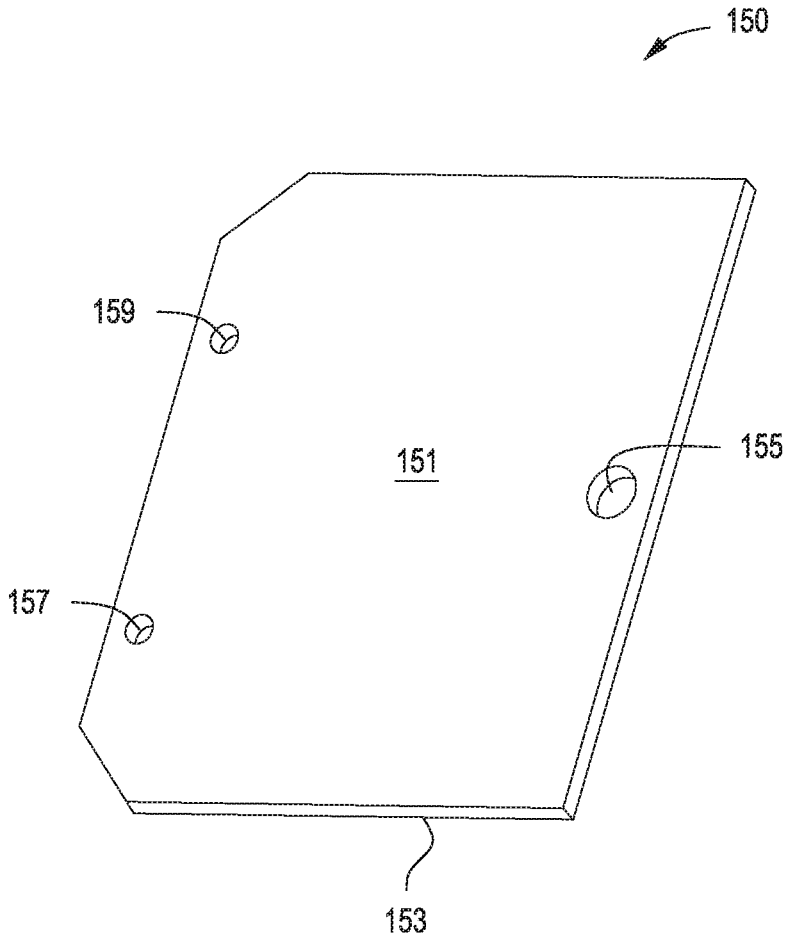
FIG. 4 depicts a perspective view of an illustrative generally horizontal base plate or shoe for the corner roller cart of FIG. 1, according to one or more embodiments provided herein.

FIG. 4 depicts a perspective view of the base plate 150, according to one or more embodiments. In addition to the discussion above, the base plate 150 can further include one or more holes or apertures 155, 157, and 159. In some embodiments, the apertures 157 and 159 can provide an additional lift point for the corner roller cart 100. In some embodiments, the aperture 155 can provide a point of connection between the base plate 150 and the corner swivel brace assembly 160. More specifically, the aperture 155 also can serve as a point of connection between the base plate 150 and the generally vertical axle support bar 164.

Figure 5:
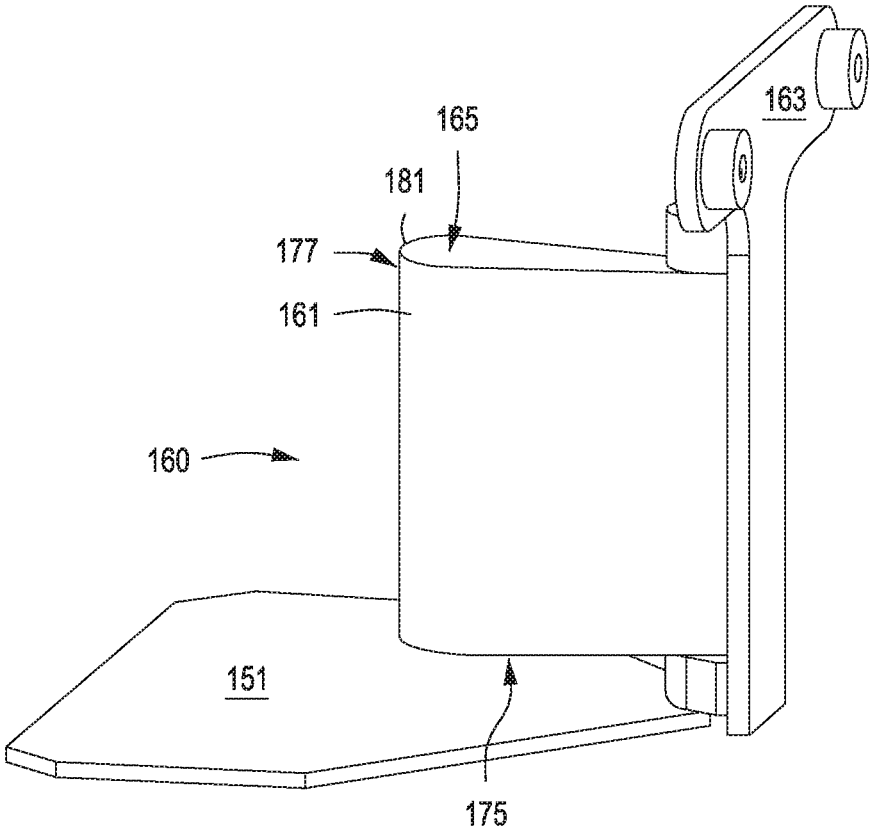
FIG. 5 depicts a side elevation view of an illustrative corner swivel brace for the corner roller cart of FIG. 1, according to one or more embodiments provided herein.

FIG. 5 depicts a side elevation view of an illustrative corner swivel brace 160 for the corner roller cart 100 of FIG. 1, according to one or more embodiments provided herein. As shown, the corner swivel brace assembly 160 can include the generally vertical teardrop support 161, having a top end 177 and a bottom end 175, where the top plate 165 can be disposed on the top end 177. The axle support bar 164 can facilitate a swivel movement of the teardrop support 161 and the top plate 165, relative to the vertical axis of the adapter 163.

Figure 6:
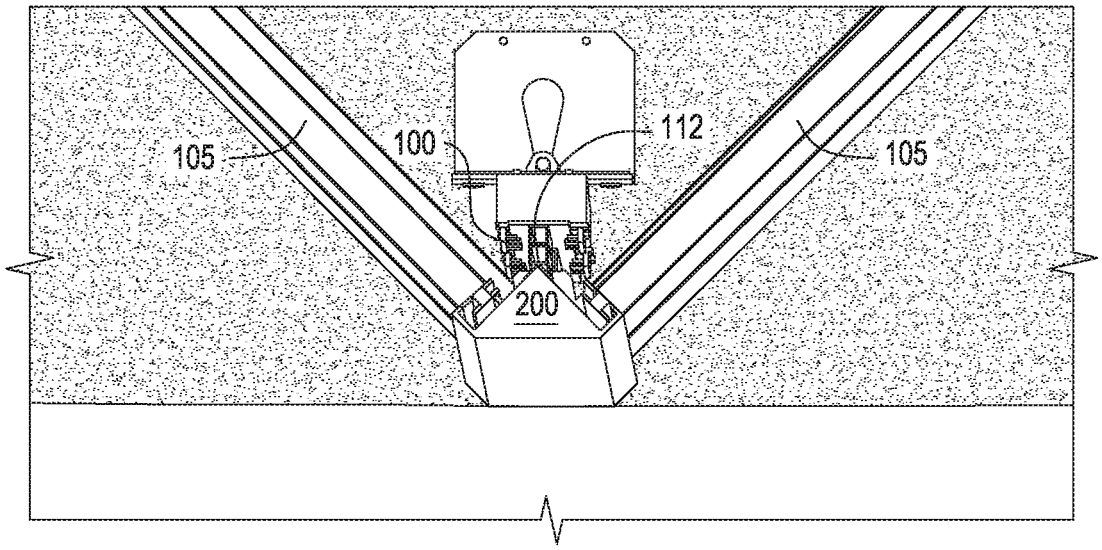
FIG. 6 depicts a top elevation view of the installation of the illustrative corner roller cart of FIG. 1.

FIG. 6 depicts a top elevation view of the installation of the illustrative corner roller cart 100 of FIG. 1. As the corner roller cart 100 is lowered onto the corner slide-rail post 200, the bottom most set of guide plates 113 can be clamped or clasped onto the vertical edges of the extended faceplate (see FIG. 7, 218). The at least one roller 112 can facilitate ease of movement of the corner roller cart 100 during both installation and removal, or for the purpose of movement in the upward and downward direction, along the vertical axis of the corner slide-rail post 200.

Figure 7:
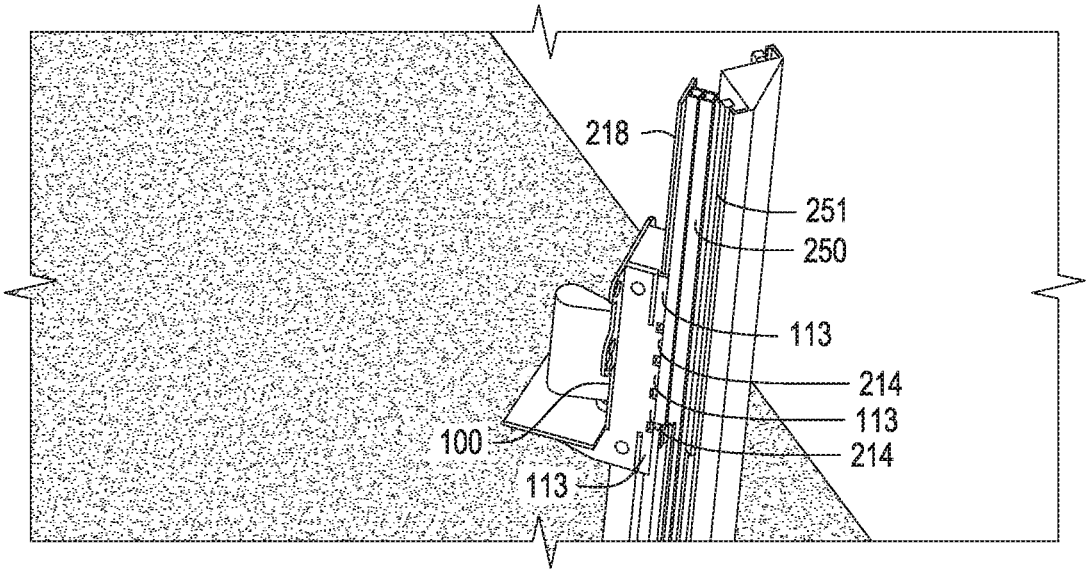
FIG. 7 depicts a side elevation view of the installation of the illustrative corner roller cart of FIG. 1.

FIG. 7 depicts a side elevation view of the installation of the illustrative corner roller cart 100 of FIG. 1. As shown, the plurality of guide plates 113 can be configured to connect to the corner slide-rail post 200 at or near an extended faceplate 218. The at least one roller 212 can have frictional contact with the extended faceplate 218, facilitating ease of movement of the corner roller cart 100 in the upward and downward direction. The extended faceplate 218 can be disposed along the longitudinal axis of the corner slide-rail post 200. The corner slide-rail post 200 can be triangular shaped, facilitating the formation of a corner in an illustrative excavation support system (see FIG. 7). For example, the triangular-shaped corner slide-rail post 200 can facilitate the formation of a corner, where the corner has an angle of at or about 90-degrees. The corner roller cart 100 can be pushed in the downward direction by the excavator boom to a desired position, where the desired position can be the base of a trench, or other position along the vertical axis of the corner slide-rail post 200.

It should also be noted that a front recessed groove or track 250 can be disposed vertically along the corner slide rail post 200, which can function as an outer track 250, wherein a first or lower elongated panel (see FIG. 10, 105) can be slideably positioned therein. In some embodiments, an additional recessed groove or track 251 can be disposed vertically along the corner slide-rail post 200, which can function as an inner track 251, wherein a second elongated panel or elongated extension panel (see FIG. 10, 106) can be slideably positioned therein. In other embodiments (not shown), at least three recessed grooves or tracks can be disposed vertically along the corner slide-rail post, wherein at least a third elongated panel or elongated extension panel can be slideably positioned therein.

Figure 8:
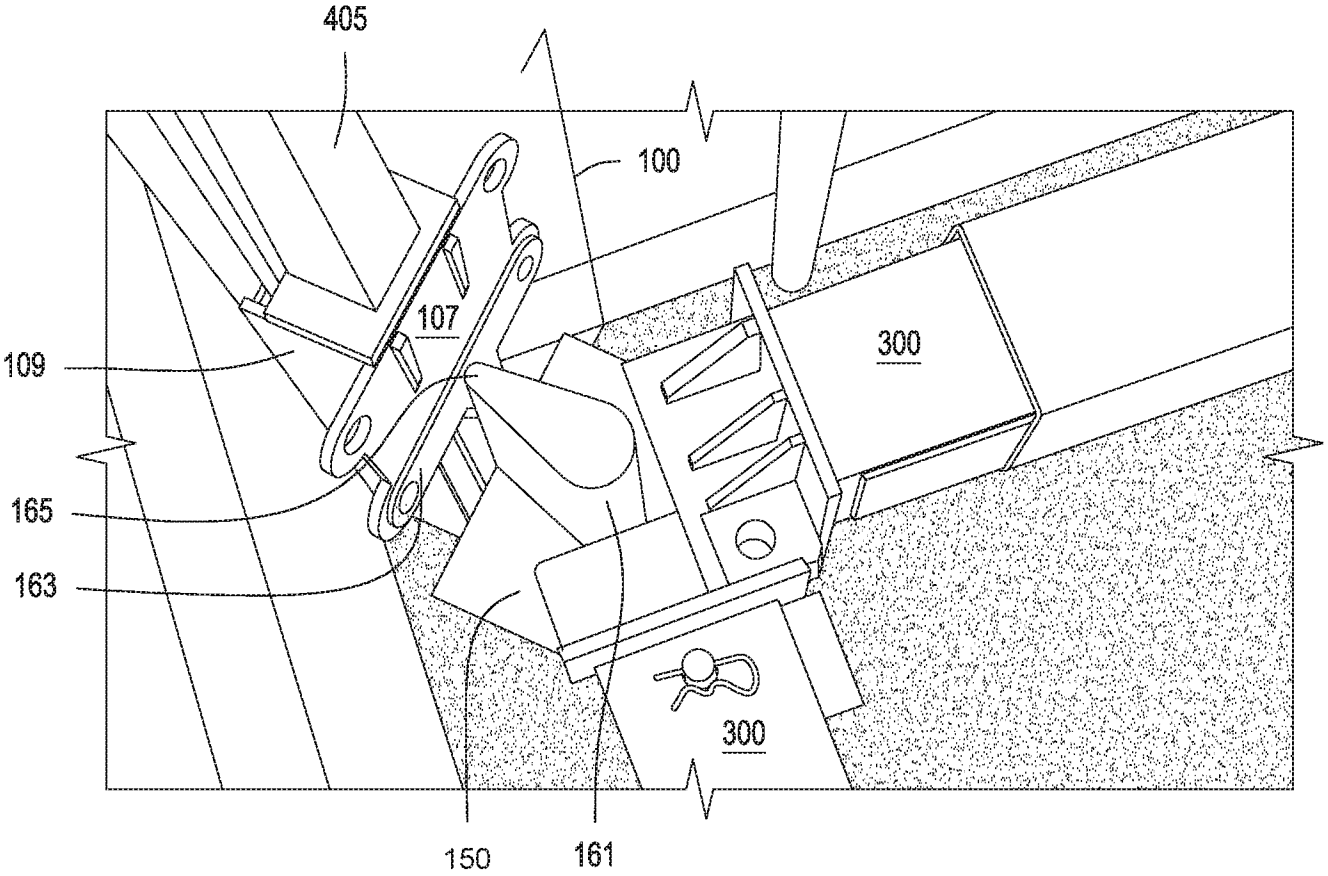
FIG. 8 is a front elevation view of a corner roller cart with one end of two brace legs adjoined on the base plate or shoe thereof, according to one or more embodiments provided herein.

FIG. 8 is a front elevation view of a corner roller cart 100 with one end of two brace legs 300 adjoined on the base plate or shoe 150 thereof, according to one or more embodiments provided herein. Hydraulic pressure can facilitate the extension of the brace legs 300 up to a stopping point, where the stopping point can be the point of contact between each of the brace legs 300 and the corner swivel brace assembly 160. More specifically, as shown in FIG. 8, the stopping point can be the point of contact between each of the brace legs 300 and the teardrop support 161, where an end 301 of the each of the brace legs 300 can overlap on the top side 151 of the base plate 150, subsequently forming an approximate 90-degree angle between one another. It should be noted that other angles ranging from 20° to 160° can be easily accommodated with minor modification. The swivel movement of the corner swivel brace assembly 160 can facilitate any adjustment required for the overlap, connection, and securing of the two brace legs 300 to the corner roller cart 100.

Figure 9:
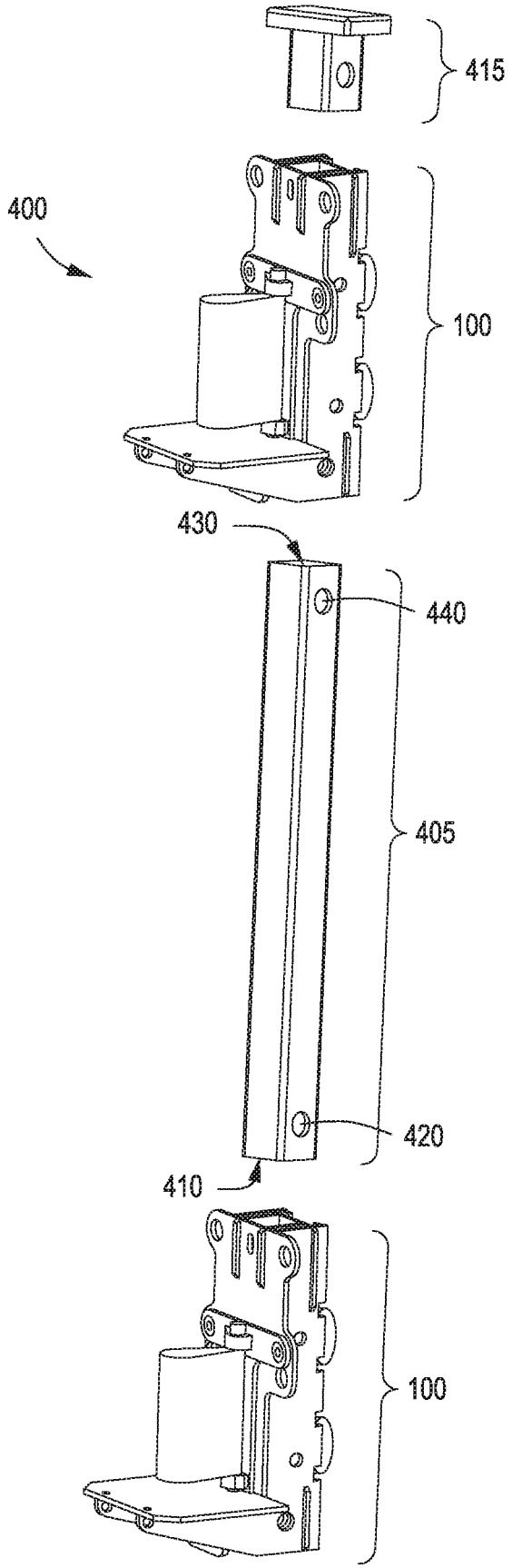
FIG. 9 is an exploded view of a corner roller cart system with two corner roller carts, a linking tube, and an optional pounding cap, according to one or more embodiments described herein.

FIG. 9 is an exploded view of a corner roller cart system 400 with two corner roller carts 100, a linking tube 405, and an optional pounding cap 415, according to one or more embodiments described herein. A linking tube 405 can be used to connect two corner roller carts 100, thereby forming a corner roller cart system 400 for an excavation support structure. The linking tube 405 can include a top end 430 and a bottom end 410. At least one aperture 440 can be formed therethrough, proximate the top end 430 of the linking tube 405, whereas at least one additional aperture 420 can be formed therethrough, proximate the bottom end 410 of the linking tube 405. The aperture 420 can be the point of connection between the first or lowermost corner roller cart 100 and the linking tube 405, whereas the aperture 440 can be the point of connection between the second or uppermost corner roller cart 100 and the linking tube 405. The linking tube 405 can be positioned between the side plates 109 of each of the corner roller carts 100.

In some embodiments, the system 400 can include the optional pounding cap 415. The optional pounding cap 415 can be connected to the uppermost corner roller cart 100. The boom of an excavator can be used to push the system 400 in the downward direction, where the point of connection between the boom and the corner roller cart system 400 can be located at the pounding cap 415. In other embodiments, the system 400 can include an optional lift ring (not shown), whereas the optional lift ring can also be connected to the uppermost linear roller cart 100. In other embodiments, the system 400 can operate without either an optional pounding cap 415 or an optional lift ring. The corner roller cart system 400 can be pushed in the downward direction by the excavator boom to a desired position, where the desired position can be the base of a trench, or any other position along the vertical axis of the corner slide-rail post 200.

The load capacity of the corner roller cart 100 can range from about 2,000 pounds to about 10,000 pounds, from about 3,000 pounds to about 9,000 pounds, from about 4,000 pounds to about 8,000 pounds or from about 5,000 pounds to about 7,000 pounds. For example, the load capacity of the corner roller cart 100 can be up about 10,000 pounds, up to about 9,000 pounds, up to about 8,000 pounds, or up to about 7,000 pounds. The total length of the corner roller cart 100, as measured from the top end 125 of the back plate 107 to the bottom portion 197 of the side plates 109, can range from about 20 inches to about 40 inches, from about 22 inches to about 38 inches, from about 24 inches to about 36 inches, from about 26 inches to about 34 inches, or from about 28 inches to about 32 inches. For example, the total length of the corner roller cart 100 can be up to about 40 inches, up to about 38 inches, up to about 36 inches, up to about 34 inches, or up to about 32 inches. The corner roller cart 100 can have a width ranging from about 15 inches to about 35 inches, from about 18 inches to about 32 inches, from about 21 inches to about 29 inches, or from about 24 inches to about 26 inches. For example, the corner roller cart 100 can have a width of up to about 35 inches, up to about 32 inches, up to about 29 inches, or up to about 26 inches.

The corner roller carts 100, the corner slide-rail posts 200, and the linking tubes 405 can be fabricated from one or more metallic materials. Suitable metallic materials, for example, can include steel, stainless steel, aluminum, copper, nickel, cast iron, galvanized or non-galvanized metals, or any alloys or mixtures thereof.

Figure 10:
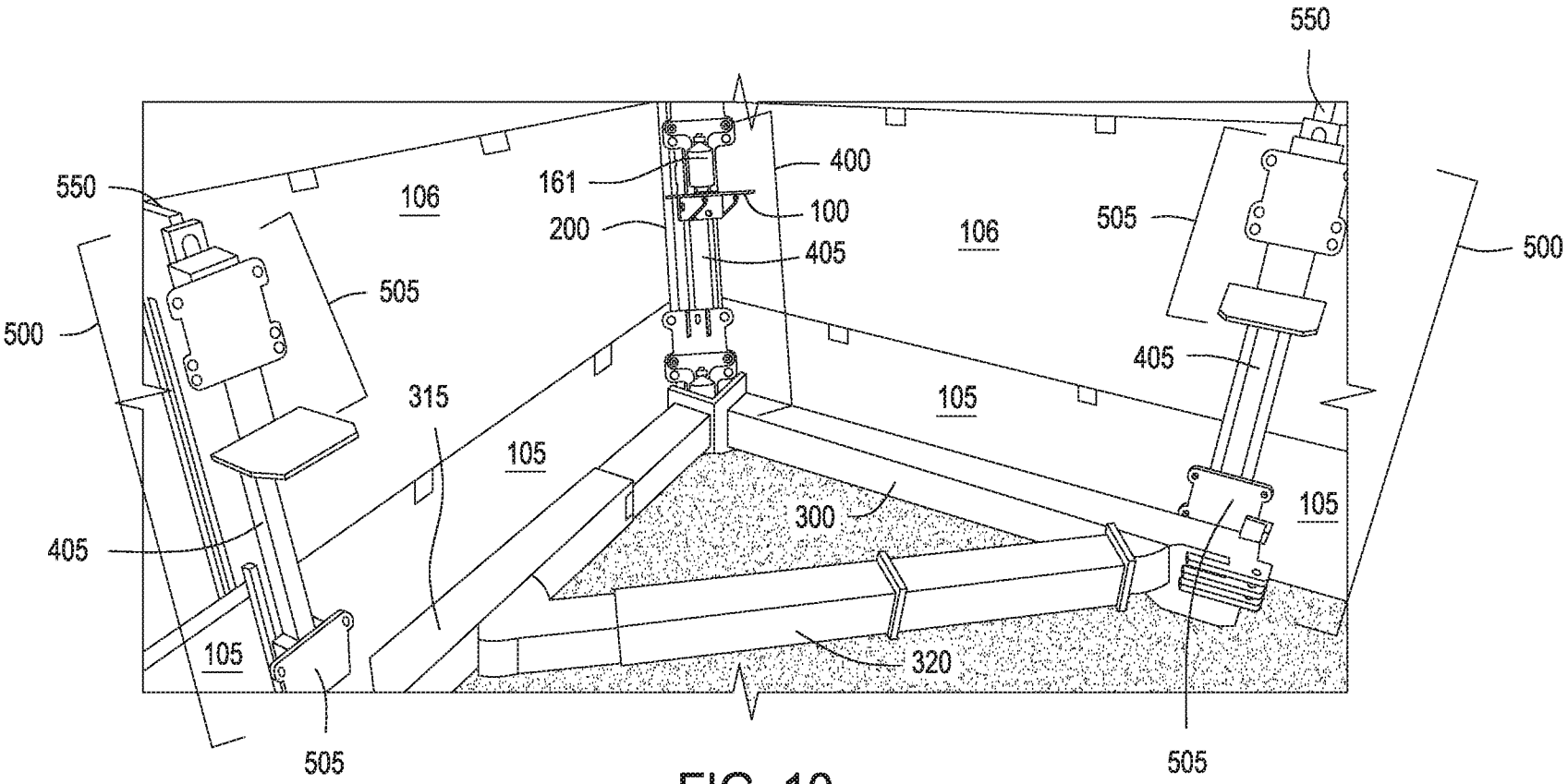
FIG. 10 is a front elevation view of one corner of an illustrative excavation support system with the corner roller cart system of FIG. 8, a linear roller cart system, two brace legs and one knee brace or crossing brace.

FIG. 10 is a front elevation view of one corner of an illustrative excavation support system 600 with the corner roller cart system 400 of FIG. 8, a linear roller cart system 500, two brace legs 300 and one knee brace or crossing brace 320. As depicted, two brace legs 300 can be connected to one another and disposed on the base plate 150 of the corner roller cart 100. In some embodiments, the brace legs 300 can be positioned between the corner slide-rail post 200 and a linear slide-rail post 550. For example, one end 303 of the brace leg 300 can be disposed on the base plate 150 of the linear roller cart 505, where the linear roller cart 505 can be disposed on the linear slide-rail post 550, and the opposing end 301 of the brace leg 300 can be disposed on the base plate 150 of the corner roller cart 100, where the corner roller cart 100 can be disposed on the corner slide-rail post 200.

A second brace leg 315 can be disposed on the base plate 150 of an adjacent linear roller cart 505, where the linear roller cart 505 can be disposed on a corresponding, adjacent linear slide-rail post 550, and the opposing end 301 of the second brace leg 315 can be disposed on the base plate 150 of the corner roller cart 100. Hydraulic pressure can be applied to the brace legs 300, 315, thereby extending the brace legs 300, 315 onto the base plate 150 of the corner roller cart 100. The brace legs 300, 315 can be hydraulically extended to a desired stopping position, where the desired stopping position can be the point of contact between the brace legs 300, 315 and the corner swivel brace assembly 160.

Figure 11:
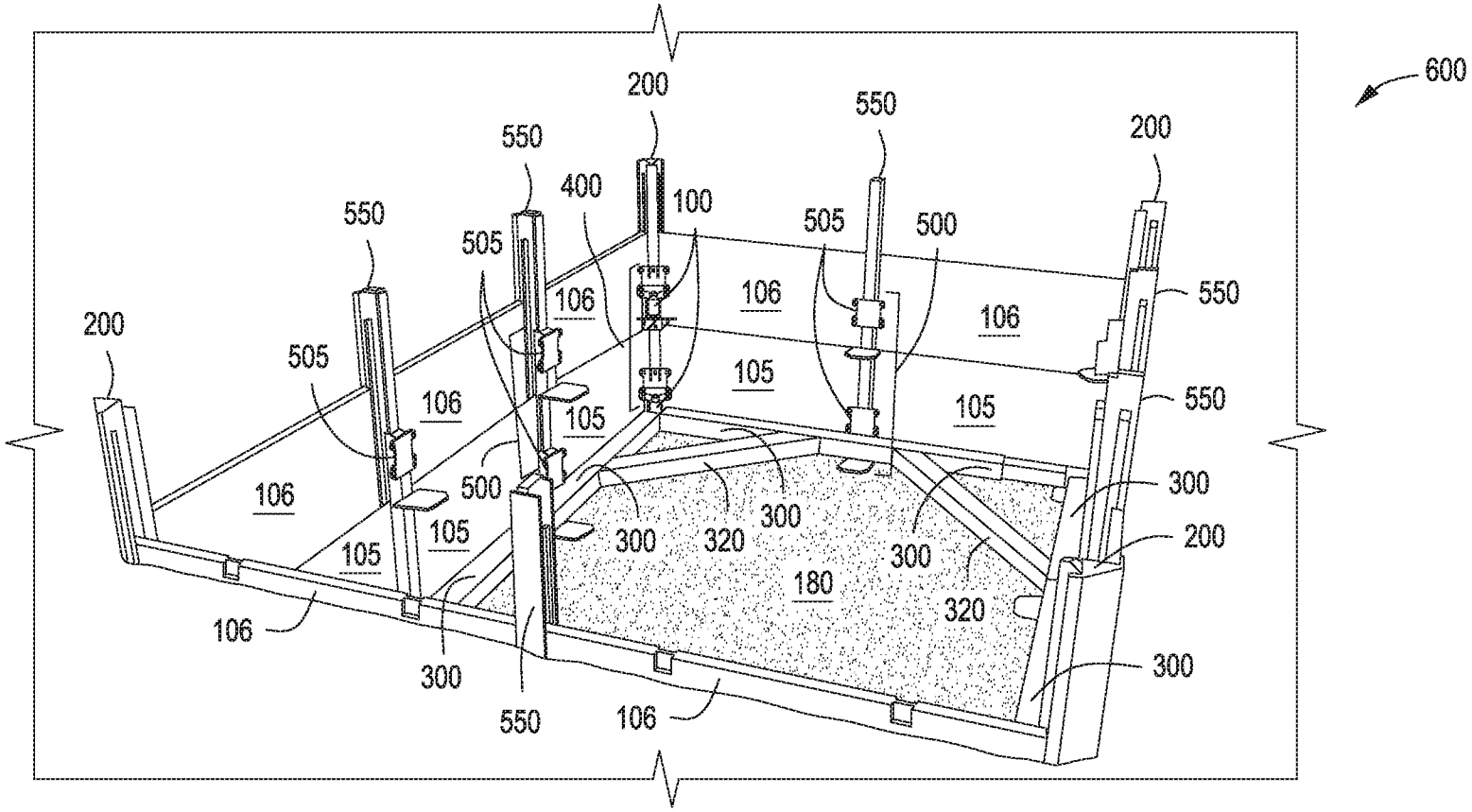
FIG. 11 depicts a front elevation view of an illustrative excavation support system, according to one or more embodiments provided herein.

FIG. 11 depicts a front elevation view of an illustrative excavation support system 600, according to one or more embodiments provided herein. The excavation support system 600 can include a plurality of corner roller carts 100, a plurality of corner slide-rail posts 200, a plurality of linear roller carts 505, a plurality of linear slide-rail posts 550, and a plurality of elongated panels 105, 106. The shape of the excavation support system 600 can vary. For example, it can be square, rectangular, hexagonal, or any other shape or geometric pattern. In some embodiments, the excavation support system 600 can include two levels of elongated panels (lower elongated panel 105 and upper elongated panel 106) layered one on top of the other. In other embodiments (not shown), the excavation support system 600 can include three or more levels of elongated panels, layered one on top of the other. The number of levels will depend on the depth of the excavation.

In some embodiments, a method of installing the corner roller cart 100 in the excavation support system 600, as illustrated in FIG. 10, can include disposing at least one corner roller cart 100 onto each of the plurality of corner slide-rail posts 200 by slideably connecting the corner roller cart 100 to the corner slide-rail post 200. In other embodiments, a method of installing the corner roller cart 100 in the excavation support system 600 can include disposing at least one corner roller cart 100 onto only a portion of the plurality of corner slide-rail posts 200. The at least one corner roller cart 100 can be adapted to slide onto each of the plurality of corner slide-rail posts 200 and secure thereto, at or near the extended faceplates 218 thereof. The at least one corner roller cart 100 can be moved in a downward direction to a desired stopping position, where the stopping position can be at the base of the trench 180.

In some embodiments, a first, or lowermost, corner roller cart 100 can be disposed on each of the plurality of corner slide-rail posts 200, connecting to the bottom end 410 of the linking tube 405, where the linking tube 405 can be positioned between side plates 109 of the lowermost corner roller cart 100. A second, or uppermost, corner roller cart 100 can also be disposed on each of the plurality of corner slide-rail posts 200, connecting to the top end 430 of the linking tube 405, where the linking tube 405 can be positioned between side plates 109 of the uppermost, corner roller cart 100, and where the uppermost corner roller cart 100 can be in vertical alignment with the lowermost corner roller cart 100, thereby forming a corner roller cart system 400 between the vertically aligned corner roller carts 100 and the linking tube 405.

A method of excavating an area can include the following steps. A trench having an inward facing side and an outer facing side can be dug using standard excavating equipment such as a backhoe or excavator. The trench can outline a square, rectangular, hexagonal, or any other shape or geometric pattern any geometric shape. A first elongated panel 105 can be inserted along the outer facing side of the trench. A linear slide rail post 550 can then be inserted where the front recessed groove or track can function as an outer track, wherein the first lower elongated panel 105 can be slideably positioned therein on both sides of the linear slide rail post. Corner slide-rail posts 200 can be used to connect the lower elongated panels 105 where the trench forms corners also using the front groove 250. These corners can be approximately 90° such that the angle formed between two corner lower elongated panels 105 is also approximately 90°. Once the lower elongated panels 105 and linear slide-rail post 550 and 200 are inserted along the entire outer facing side of the trench, the area outlined by the trench can be excavated.

After the area is excavated, first linear roller carts 505 can be slideably inserted on linear slide-rail post 550 and first corner roller carts 100 can be slideably inserted on corner slide rail posts 200. Brace legs 300 can then be connected to first roller carts 505 and first corner rail carts 100. Additional crossing braces 320 can also be connected to brace legs 300. Linking tube 405 can be connected to the first roller cart 505 or first corner roller cart 100 at or near the bottom end 410, and secured at the aperture 420. The linking tube 405 can also be connected to a second roller cart 200 or second corner roller cart at or near the top end 430, and secured at the aperture 440.

After the brace legs 300 are connected to the first linear roller carts 505 and first corner roller carts 100, a second set of lower elongated panels can be slideably positioned in the additional recessed groove or track that can function as an inner track of the linear slide-rail post 550 and corner slide rail posts 115. Brace legs 300 can be connected to the second roller carts 505 and second corner rail carts 100. Additional crossing braces 320 can also be connected to brace legs 300.

After the brace legs 300 are connected to the second roller carts 505 and second corner rail carts 100, one of the two lower elongated panels connected to the slide posts 550 and 200 can be forced further into the ground using any machinery capable of generating enough downward force such as a backhoe.

After the entire perimeter of lower elongated panels 105 is lowered, the area inside is excavated again and the system of roller carts 505, corner roller carts 100, linear slide rail posts 550, corner slide rail posts 200, brace legs 300 and crossing braces 320 can be lowered to the base of the excavated area. First upper elongated panels 106 can be slideably positioned in a grove of the linear slide rail posts 550 and corner slide rail posts 200 such that the first upper elongated panels 106 are in the same grove as the lower elongated panel that has not been forced further into the ground.

After the first upper elongated panels 106 are in place, the first upper elongated panel and the lower elongated panel can be forced further into the ground until the first lower elongated panels and the second lower elongated panels are at substantially the same depth. A second upper elongated panel can be inserted in the grove that is not occupied by the first upper elongated panel. This process can be repeated until the depth of the excavated area is 3, 4, 5, or more panels deep.

Embodiments of the present disclosure further relate to any one or more of the following paragraphs 1 to 20:

1. A corner roller cart for an excavation support system, comprising: (a) a generally vertical back plate having a front surface, a back surface, a top end, and a bottom end; (b) a generally horizontal base plate having a top side and a bottom side, the base plate attached to the back plate at about a 90-degree angle, proximate the bottom end of the back plate; (c) at least one roller, connected to the back plate, extending from the back surface thereof; (d) a corner swivel brace disposed on the top side of the base plate and connected to the front surface of the back plate, the corner swivel brace comprising: (i) an adapter, wherein the adapter is configured to attach the corner swivel brace to the back plate of the corner cart; (ii) a generally vertical axle support bar having a top end and a bottom end, wherein the axle support bar is connected to the adapter; (iii) a generally vertical tube support having a top end and a bottom end; (iv) a top plate having a first end and a second end, wherein the first end is disposed on the top end of the tube support, and the second end is generally perpendicular to and connected to the axle support bar; wherein the axle support bar configured to swivel the support tube and the top plate relative to the vertical axis of the adapter; (e) a first side plate and a second side plate, wherein the side plates are generally L-shaped, having a generally vertical top portion, and a bottom portion that is generally perpendicular to the top portion, wherein the top portion of both side plates is attached to and generally perpendicular to the back surface of the back plate, wherein the bottom portion of both side plates is attached to and generally perpendicular to the bottom side of the base plate, and wherein the first side plate and the second side plate are generally parallel to one another; and (f) a first plurality of guide plates attached to, and generally perpendicular to, the generally vertical top portion of the first side plate, and a second plurality of guide plates that is attached to, and generally perpendicular to, the generally vertical top portion of the second side plate, and wherein the corner roller cart is movable in an upward and downward direction relative to a vertical axis.

2. The corner roller cart according to paragraph 1, wherein the corner roller cart is movable in in an upward and downward direction relative to the vertical axis of a corner slide-rail post, wherein the corner slide-rail post can be triangular shaped, facilitating the formation of a corner in the excavation support system, wherein the corner has an angle of at or about 90-degrees.

3. The corner roller cart according to paragraph 1 or 2, wherein the corner slide-rail post further comprises an extended faceplate disposed along the longitudinal axis thereof.

4. The corner roller cart according to any one or more paragraphs 1 to 3, wherein the guide plates are configured to slide onto and secure to the extended faceplate of the corner slide-rail post, and wherein the guide plates are configured to facilitate slideable movement of the corner roller cart in an upward and downward direction relative to the vertical axis of the corner slide-rail post.

5. The corner roller cart according to any one or more paragraphs 1 to 4, wherein the base plate is configured to support at least one brace leg.

6. The corner roller cart according to any one or more paragraphs 1 to 5, wherein the corner swivel brace facilitates adjoining two brace legs at about a 90-degree angle on the base plate.

7. The corner roller cart according to any one or more paragraphs 1 to 6, wherein the adapter configured is to be T-shaped.

8. The corner roller cart according to any one or more paragraphs 1 to 7, wherein the support tube is a teardrop support tube.

9. The corner roller cart according to any one or more paragraphs 1 to 8, wherein the bottom end of the tube support is disposed on and generally perpendicular to the bottom plate.

10. The corner roller cart according to any one or more paragraphs 1 to 9, wherein the at least one roller is connected to a shaft, wherein the roller can rotate with the shaft.

11. The corner roller cart according to any one or more paragraphs 1 to 10, wherein the at least one roller is connected to a shaft, wherein the roller can rotate around the shaft.

12. A corner roller cart system for an excavation support system, the corner roller cart system comprising: (a) a first corner roller cart and a second corner roller cart, each of the corner roller carts comprising: (i) a generally vertical back plate having a front surface, a back surface, a top end, and a bottom end; (ii) a generally horizontal base plate, having a top side and a bottom side, attached to the back plate at about a 90-degree angle, proximate the bottom end of the back plate; (iii) a first side plate and a second side plate, wherein both side plates are generally L-shaped, having a generally vertical top portion, and a bottom portion that is generally perpendicular to the top portion, wherein the top portion of both side plates is attached to and generally perpendicular to the back surface of the back plate, wherein the bottom portion of both side plates is attached to and generally perpendicular to the bottom side of the base plate, and wherein the first side plate and the second side plate are generally parallel to one another; (iv) a first plurality of guide plates attached to, and generally perpendicular to the generally vertical top portion of the first side plate, and a second plurality of guide plates attached to, and generally perpendicular to the generally vertical top portion of the second side plate; (v) at least one roller connected to the back plate, extending from the back surface thereof; and (vi) a corner swivel brace, disposed on the top side of the base plate and connected to the front surface of the back plate, comprising: (1) an adapter, wherein the adapter is configured to attach the corner swivel brace to the back plate of the corner cart; (2) a generally vertical axle support bar having a top end and a bottom end, wherein the axle support bar is connected to the adapter; (3) a generally vertical tube support having a top end and a bottom end; (4) a top plate having a first end and a second end, wherein the first end is disposed on the top end of the tube support, and the second end is generally perpendicular to and connected to the axle support bar; wherein the axle support bar facilitates swivel movement of the support tube and the top plate relative to the vertical axis of the adapter; and (b) a linking tube configured to connect the first corner roller cart and the second corner roller cart when vertically aligned, wherein the linking tube has a top end and a bottom end, wherein the bottom end is positioned between the first side plate and the second side plate of the first corner roller cart, and wherein the top end is positioned between the first side plate and the second side plate of the second corner roller cart, the corner roller cart system being moveable in an upward and a downward direction relative to a vertical axis.

13. The corner roller cart according to paragraph 12, wherein the corner roller cart system is movable in an upward and a downward direction relative to the vertical axis of a corner slide-rail post, and wherein the corner roller cart system is adapted to slide onto the corner slide-rail post and secure thereto.

14. The corner roller cart system according to paragraph 12 or 13, wherein the corner slide-rail post further comprises an extended faceplate disposed along the longitudinal axis thereof.

15. The corner roller cart system according to any one or more paragraphs 12 to 14, wherein the plurality of guide plates of both corner roller carts are configured to slide onto and secure to the extended faceplate of the corner slide-rail post, and wherein the plurality of guide plates are configured to facilitate slideable movement of the corner roller cart system in an upward and a downward direction relative to the vertical axis of the corner slide-rail post.

16. The corner roller cart system according to any one or more paragraphs 12 to 15, wherein the base plates of both corner roller carts are configured to support at least one brace leg.

17. The corner roller cart system according to any one or more paragraphs 12 to 17, wherein the corner swivel brace of each corner roller cart facilitates adjoining two brace legs at about a 90-degree angle on the base plate of each corner roller cart.

18. A method of installing a corner roller cart in an excavation support system comprising: (a) disposing at least a first corner roller cart on a corner slide-rail post, wherein the corner roller cart comprises: (i) a generally vertical back plate having a front surface, a back surface, a top end, and a bottom end; (ii) a generally horizontal base plate, having a top side and a bottom side, attached to the back plate at about a 90-degree angle, proximate the bottom end of the back plate; (iii) a first side plate and a second side plate, wherein both side plates are generally L-shaped, having a generally vertical top portion, and a bottom portion that is generally perpendicular to the top portion, wherein the top portion of both side plates is attached to and generally perpendicular to the back surface of the back plate, wherein the bottom portion of both side plates is attached to and generally perpendicular to the bottom side of the base plate, and wherein the first side plate and the second side plate are generally parallel to one another; (iv) a first plurality of guide plates attached to, and generally perpendicular to, the generally vertical top portion of the first side plate, and a second plurality of guide plates attached to, and generally perpendicular to, the generally vertical top portion of the second side plate; (v) at least one roller connected to the back plate, extending from the back surface thereof; and (vi) a corner swivel brace, disposed on the top side of the base plate and connected to the front surface of the back plate, comprising: (1) an adapter, wherein the adapter is configured to attach the corner swivel brace to the back plate of the corner cart; a generally vertical axle support bar having a top end and a bottom end, wherein the axle support bar is connected to the adapter; (2) a generally vertical tube support having a top end and a bottom end; (3) a top plate having a first end and a second end, wherein the first end is disposed on the top end of the tube support, and the second end is generally perpendicular to and connected to the axle support bar; and wherein the axle support bar facilitates swivel movement of the support tube and the top plate relative to the vertical axis of the adapter, the corner roller cart being movable in an upward and downward direction relative to a vertical axis.

19. The method according to paragraph 18, further comprising moving the corner roller cart in the downward direction relative to the vertical axis of the corner slide-rail post to a desired stopping position.

20. The method according to paragraph 18 or 19, further comprising connecting a linking tube to the first corner roller cart in vertical alignment therewith, the linking tube having a top end and a bottom end, wherein the bottom end is positioned between the first side plate and the second side plate of the first slide cart, and wherein the top end is positioned between the first side plate and the second side plate of the second corner roller cart.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, patent application publications, test procedures, and other documents cited in this application are fully incorporated by reference herein to the extent such disclosure is not inconsistent with this application and for all jurisdictions in which such incorporation is permitted.

While the foregoing has been disclosed and described in preferred forms with a certain degree of particularity, it is understood that the present disclosure of the preferred forms is only by way of example and that numerous changes in the details of operation and in the combination and arrangement of parts may be resorted to without departing from the spirit and scope of the invention, which is defined by the claims that follow.

While the foregoing has been disclosed and described in preferred forms with a certain degree of particularity, it is understood that the present disclosure of the preferred forms is only by way of example and that numerous changes in the details of operation and in the combination and arrangement of parts may be resorted to without departing from the spirit and scope of the invention, which is defined by the claims that follow.

What is claimed is:

1. A corner roller cart for facilitating the formation of a corner of an excavation support system, comprising:

a generally vertical back plate having a front surface, a back surface, a top end, and a bottom end;

a generally horizontal base plate having a top side and a bottom side, the base plate attached to the back plate at about a 90-degree angle, proximate the bottom end of the back plate;

at least one roller, connected to the back plate, extending from the back surface thereof;

a corner swivel brace disposed on the top side of the base plate and connected to the front surface of the back plate, the corner swivel brace comprising:

an adapter, wherein the adapter is configured to attach the corner swivel brace to the back plate of the corner cart;

a generally vertical axle support bar having a top end and a bottom end, wherein the axle support bar is connected to the adapter;

a generally vertical tube support having a top end and a bottom end;

a top plate having a first end and a second end, wherein the first end is disposed on the top end of the tube support, and the second end is generally perpendicular to and connected to the axle support bar;

wherein the axle support bar configured to swivel the support tube and the top plate relative to the vertical axis of the adapter;

a first side plate and a second side plate, wherein the side plates are generally L-shaped, having a generally vertical top portion, and a bottom portion that is generally perpendicular to the top portion, wherein the top portion of both side plates is attached to and generally perpendicular to the back surface of the back plate, wherein the bottom portion of both side plates is attached to and generally perpendicular to the bottom side of the base plate, and wherein the first side plate and the second side plate are generally parallel to one another; and a first plurality of guide plates attached to, and generally perpendicular to, the generally vertical top portion of the first side plate, and a second plurality of guide plates that is attached to, and generally perpendicular to, the generally vertical top portion of the second side plate, and wherein the corner roller cart is movable in an upward and downward direction relative to a vertical axis.

2. The corner roller cart of claim 1, wherein the corner roller cart is movable in an upward and downward direction relative to the vertical axis of a corner slide-rail post, wherein the corner slide-rail post is triangular shaped, forming the corner of the excavation support system, wherein the corner has an angle of at or about 90-degrees.

3. The corner roller cart of claim 2, wherein the corner slide-rail post further comprises an extended faceplate disposed along the longitudinal axis thereof.

4. The corner roller cart of claim 3, wherein the guide plates are configured to slide onto and secure to the extended faceplate of the corner slide-rail post, and wherein the guide plates are configured to facilitate slideable movement of the corner roller cart in an upward and downward direction relative to the vertical axis of the corner slide-rail post.

5. The corner roller cart of claim 1, wherein the base plate is configured to support at least one brace leg.

6. The corner roller cart of claim 5, wherein the corner swivel brace facilitates adjoining two brace legs at about a 90-degree angle on the base plate.

7. The corner roller cart of claim 5, wherein the adapter configured is to be T-shaped.

8. The corner roller cart of claim 1, wherein the support tube is a teardrop support tube.

9. The corner roller cart of claim 8, wherein the bottom end of the tube support is disposed on and generally perpendicular to the bottom plate.

10. The corner roller cart of claim 1, wherein the at least one roller is connected to a shaft, wherein the roller can rotate with the shaft.

11. The corner roller cart of claim 1, wherein the at least one roller is connected to a shaft, wherein the roller can rotate around the shaft.

12. A corner roller cart system for facilitating the formation of a corner of an excavation support system, the corner roller cart system comprising:

a first corner roller cart and a second corner roller cart, each of the corner roller carts comprising:

a generally vertical back plate having a front surface, a back surface, a top end, and a bottom end;

a generally horizontal base plate, having a top side and a bottom side, attached to the back plate at about a 90-degree angle, proximate the bottom end of the back plate;

a first side plate and a second side plate, wherein both side plates are generally L-shaped, having a generally vertical top portion, and a bottom portion that is generally perpendicular to the top portion, wherein the top portion of both side plates is attached to and generally perpendicular to the back surface of the back plate, wherein the bottom portion of both side plates is attached to and generally perpendicular to the bottom side of the base plate, and wherein the first side plate and the second side plate are generally parallel to one another;

a first plurality of guide plates attached to, and generally perpendicular to the generally vertical top portion of the first side plate, and a second plurality of guide plates attached to, and generally perpendicular to the generally vertical top portion of the second side plate;

at least one roller connected to the back plate, extending from the back surface thereof; and a corner swivel brace, disposed on the top side of the base plate and connected to the front surface of the back plate, comprising:

an adapter, wherein the adapter is configured to attach the corner swivel brace to the back plate of the corner cart;

a generally vertical axle support bar having a top end and a bottom end, wherein the axle support bar is connected to the adapter;

a generally vertical tube support having a top end and a bottom end;

a top plate having a first end and a second end, wherein the first end is disposed on the top end of the tube support, and the second end is generally perpendicular to and connected to the axle support bar;

wherein the axle support bar facilitates swivel movement of the support tube and the top plate relative to the vertical axis of the adapter; and a linking tube configured to connect the first corner roller cart and the second corner roller cart when vertically aligned, wherein the linking tube has a top end and a bottom end, wherein the bottom end is positioned between the first side plate and the second side plate of the first corner roller cart, and wherein the top end is positioned between the first side plate and the second side plate of the second corner roller cart, the corner roller cart system being moveable in an upward and a downward direction relative to a vertical axis.

13. The corner roller cart of claim 12, wherein the corner roller cart system is movable in an upward and a downward direction relative to the vertical axis of a corner slide-rail post, and wherein the corner roller cart system is adapted to slide onto the corner slide-rail post and secure thereto.

14. The corner roller cart system of claim 12, wherein the corner slide-rail post further comprises an extended faceplate disposed along the longitudinal axis thereof.

15. The corner roller cart system of claim 13, wherein the plurality of guide plates of both corner roller carts are configured to slide onto and secure to the extended faceplate of the corner slide-rail post, and wherein the plurality of guide plates are configured to facilitate slideable movement of the corner roller cart system in an upward and a downward direction relative to the vertical axis of the corner slide-rail post.

16. The corner roller cart system of claim 12, wherein the base plates of both corner roller carts are configured to support at least one brace leg.

17. The corner roller cart system of claim 16, wherein the corner swivel brace of each corner roller cart facilitates adjoining two brace legs at about a 90-degree angle on the base plate of each corner roller cart.

18. A method of installing a corner roller cart in an excavation support system comprising:

disposing at least a first corner roller cart on a corner slide-rail post, wherein the corner roller cart comprises:

a generally vertical back plate having a front surface, a back surface, a top end, and a bottom end;

a generally horizontal base plate, having a top side and a bottom side, attached to the back plate at about a 90-degree angle, proximate the bottom end of the back plate;

a first side plate and a second side plate, wherein both side plates are generally L-shaped, having a generally vertical top portion, and a bottom portion that is generally perpendicular to the top portion, wherein the top portion of both side plates is attached to and generally perpendicular to the back surface of the back plate, wherein the bottom portion of both side plates is attached to and generally perpendicular to the bottom side of the base plate, and wherein the first side plate and the second side plate are generally parallel to one another;

a first plurality of guide plates attached to, and generally perpendicular to, the generally vertical top portion of the first side plate, and a second plurality of guide plates attached to, and generally perpendicular to, the generally vertical top portion of the second side plate;

at least one roller connected to the back plate, extending from the back surface thereof;

and a corner swivel brace, disposed on the top side of the base plate and connected to the front surface of the back plate, comprising: an adapter, wherein the adapter is configured to attach the corner swivel brace to the back plate of the corner cart; a generally vertical axle support bar having a top end and a bottom end, wherein the axle support bar is connected to the adapter;

a generally vertical tube support having a top end and a bottom end;

a top plate having a first end and a second end, wherein the first end is disposed on the top end of the tube support, and the second end is generally perpendicular to and connected to the axle support bar; and wherein the axle support bar facilitates swivel movement of the support tube and the top plate relative to the vertical axis of the adapter;

the corner roller cart being movable in an upward and downward direction relative to a vertical axis.

19. The method of claim 18, further comprising moving the corner roller cart in the downward direction relative to the vertical axis of the corner slide-rail post to a desired stopping position.

20. The method of claim 18, further comprising connecting a linking tube to the first corner roller cart in vertical alignment therewith, the linking tube having a top end and a bottom end, wherein the bottom end is positioned between the first side plate and the second side plate of the first slide cart, and wherein the top end is positioned between the first side plate and the second side plate of the second corner roller cart.

* * * * *